United States Patent [19]

DeCesare

[11] 4,090,713

[45] May 23, 1978

[54] HARNESS HORSE RACING ELECTRIC SYSTEM

[76] Inventor: Dominic V. DeCesare, 223 Center St., Elizabeth, N.J. 07202

[21] Appl. No.: 789,688

[22] Filed: Apr. 21, 1977

[51] Int. Cl.[2] ..... A63F 9/14; H02P 1/58

[52] U.S. Cl. ..... 273/86 B; 46/259; 46/265; 318/102

[58] Field of Search ..... 273/86 B, 86 F, 86 G; 46/251, 259, 265; 318/102

[56] References Cited

U.S. PATENT DOCUMENTS

| | | | |
|---|---|---|---|
| 2,133,165 | 10/1938 | Eisenberg et al. | 273/86 F |
| 2,180,448 | 11/1939 | Williams | 273/86 B |
| 2,604,323 | 7/1952 | Smith et al. | 273/86 F |
| 3,815,912 | 6/1974 | Wichinsky et al. | 273/86 F |

*Primary Examiner*—Anton O. Oechsle

[57] ABSTRACT

In a preferred embodiment, there is provided a symbolic plurality of parallel racing lanes and racing horse-drawn sulkies, which sulkies have respective electric motor-driven wheels by drive shafts thereof having electrical commutators mounted operatively thereon furnishing commutator intermittent direct current to pivot swinging legs' electromagetic induction coils and responsive material on the legs responsive movably to induction in the coils when activated to thereby by intermittent activation cause the legs to swing to and fro as if running, respective sulkies being driven at chance intervals of time periods and at chance rates of speeds by a speed regulator mechanism which includes in series on a cyclically rotating disk a plurality of alternate electrical contact strips in electrical parallel for consecutive contact with all power leads to the motors of the sulkies but at different starting-points on the disk for different sulkies at any particular non-specific time of beginning the race of sulkies, and associated with each alternate electrical contact strip there being an electrical resistance in series different and diverse relative to resistances of others of the electrical-parallel alternate electrical contact strips, such that each sulky's speed is relative to both the length of the contact strip then in series intermittently, as well as the particular resistance associated with that particular contact strip, anchored to a track.

10 Claims, 10 Drawing Figures

Fig. 1.
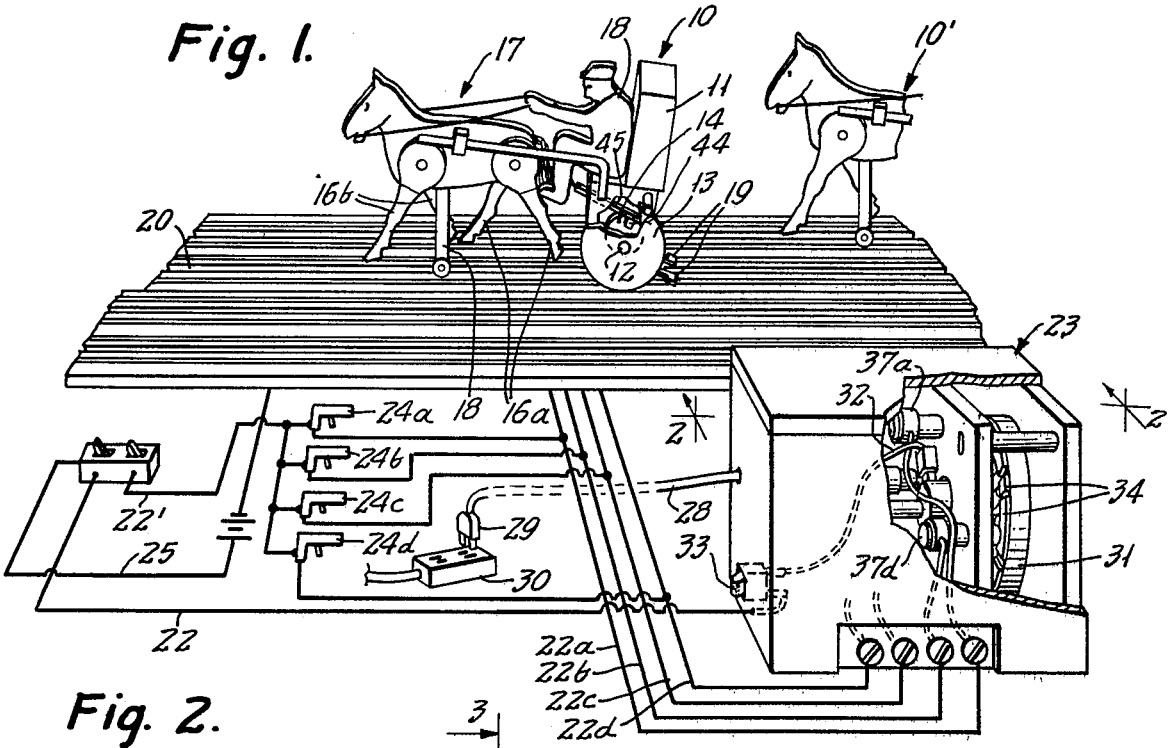
Fig. 2.
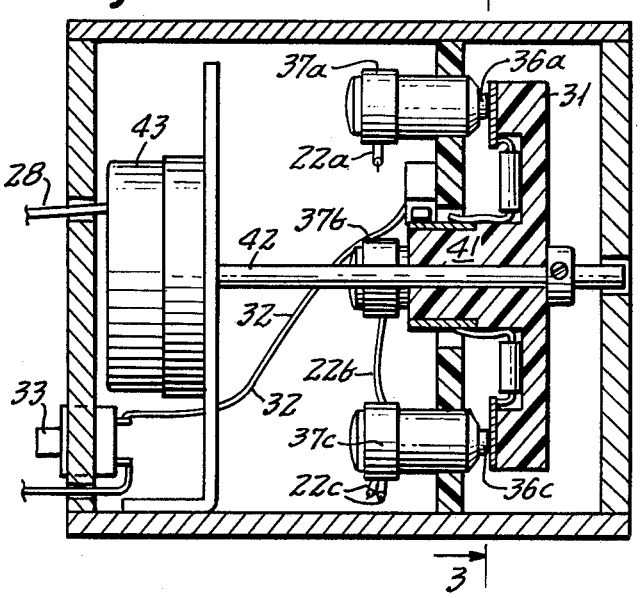
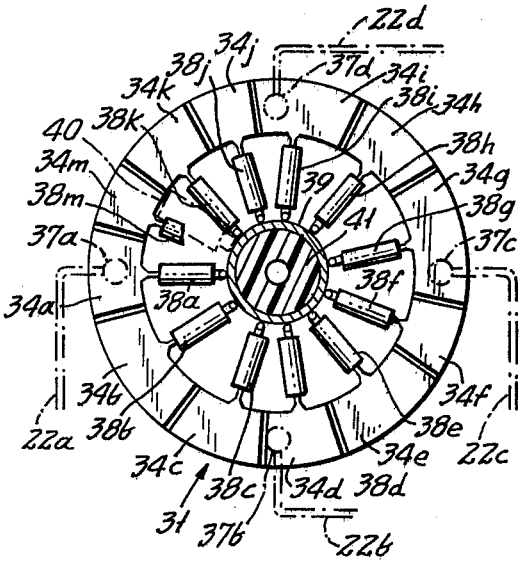
Fig. 3.
Fig. 10.
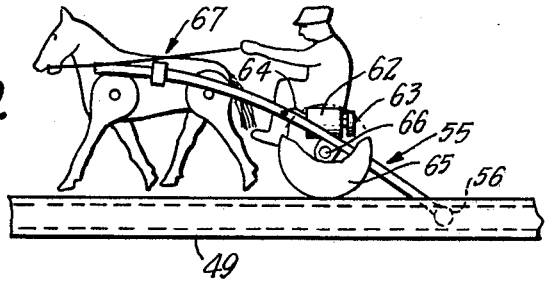

HARNESS HORSE RACING ELECTRIC SYSTEM

This invention relates to an electrical amusement device in the nature of side-by-side track racing of electric motor driven toy devices.

BACKGROUND TO THE INVENTION

Heretofore there has not been any device of simple construction and low cost of manufacture which would effectively scramble speeds of vehicles racing one-another each by a separate electric motor. Also, there has been no effective way either alone or in combination with a scrambler of activation periods, for also varying the rate of speed whenever energized. Also, while there have been symbolic motor-vehicles, there has been no animated animal races, much less animal-pulled vehicular races which might realistically give the impression of actual horses running the race together with legs-movement thereof. Also, for such animated symbolic racing entities, there has been no manually controlled device for separate control manually-of-switches by different switches of respectively different horses enabling different players to control speed at-least-in-part, preventing the toppling over of horses and/or vehicles that might occur if too great a speed takes-place around a curve, or the like.

SUMMARY OF THE INVENTION

Accordingly, objects of the invention include the overcoming of deficiencies and short-comings and difficulties of the art heretofore, together with the obtaining of novel combinations and advantages thereof.

In particular, an object of the invention is to obtain a speed scrambling device for non-predictably selecting alternate total period(s) of running during a particular race, different from total periods of other racing entities.

Another object is to obtain a speed scrambling device for non-predictably selecting a composite of consecutive series of different rates of speed during a particular race, different from total and average speeds of other racing entities.

Another object is to obtain an animated horse and/or harness sulky race device, sufficiently animated as to add a true sense of reality and realism to the movement of the horses or the like.

Another object is to obtain a novel anchoring track mechanism.

Another object is to obtain intermittent animated legs-movement of animal-legs of a racing animal, during and relative to movement and rate of movement of the racing animal down the racing track.

Another object is to provide for either and/or alternate speed-scrambler control and individual manual control of activation and speed-control switch(es) in movement enabling total automatically controlled and unpredictable-outcome races between competitive racing entities and/or personal control by competitive individuals controlling manually the switch(es).

Another object is to obtain a device obtaining concurrently a plurality of foregoing objects.

Another object is to obtain one or more of prior objects at low cost of parts, and/or by simple circuitry, and at low and economically feasible cost(s) of production thereof.

One or more of these objects are obtained by embodiments illustrated merely as typical, for improved understanding of the operation of the invention, together with other objects apparent from preceding and following disclosure.

Broadly the invention may be defined as an electrically circuited amusement game device having separate racing electrical motors in electrical parallel circuits, the total periods of electrical activation and the rate(s) of speed(s) during one or more periods of activation(s) for each racing electric motor being made unpredictable and random selection by a power regulator which selects from a cyclic system the random beginning points for the respective ones of the racing electrical motors, a drive mechanism of the power regulator being continually altering the beginning points of the cycle relative to intermittent beginnings of new races from a start point on the racing track(s). In a preferred system, there is also matched with each racing electrical motor, an electromagnetic motor and circuitry therefor having in series within its circuitry an electrical commutator for intermittent making and breaking circuit to the electromagnetic motor, in which the electrical commutator is mounted with and driven by the motor shaft of the motor with which it is matched, and accordingly the rate of activation of the electromagnetic motor is proportional to the rate of speed and to the periods of activation of that particular racing electrical motor. The electromagnetic motor preferably is utilized to move a set of paired legs in rocking to and from movement, with the legs hanging from a pivot point, downwardly by gravity except when caused to move on the pivot by magnetic induction from an induction coil acting by the induction on a responsive material such as one or more bar magnets or other responsive metallic-property material mounted on the pivoted set of paired legs. There may be and are preferably two electromagnetic motors in electrical parallel one for one front set of legs and one for one back set of legs, and further preferably the coils are arranged relative to their respective movable material such that one set of legs is moved in one direction while concurrently the other set of legs is moved in an opposite direction. It is recognized that both set of legs could be driven by a common induction coil with the material at the same end or at opposite ends of the coils, together with well-known leverage devices, conventional in the prior art.

The power regulator preferably consists of a rotary member such as preferably a disk, having along a periphery thereof or in juxtaposition to that periphery, a plurality of separate conductor contact strips arranged in mechanical series such that as the disk continuously rotates while activated (energized electrically, the driving motor thereof) the contact strips consecutively move into contact with, and eventually past and out-of-contact with respective ones of lead lines of circuitry to separate ones of the racing electrical motors; when the racing entities are mechanically or manually arranged even with one-another at a starting line and thereafter their respective racing electrical motor circuits closed as the race begins, there is no way of ascertaining which respective ones of the racing electrical motors are in contact with any of various diverse contact strips, the contact strips being of diverse and differing lengths, such that for an indeterminate point of begining within a cycle that moves continually and begins repeating repeatedly and cyclically, only by random chance is the total closed-circuit time period for each respective racing motor determined; and such total period will vary from that of other racing motors, as well as by chance will vary from race to race. Additionally, however, another variable is thrown-in by there being placed in circuit with the respective separate contact strips, different electrical resistors, the total resistance associated with on contact strip differing from the total resistance of one or more of each other different contact strip (& associated resistor), whereby not only does the period vary from strip to strip, but additionally the resistance and thus the speed of the electrical motor in its revolutions per minute, also varies, thereby making very significant minor changes in the beginning point for the several competitive racing electrical motors relative to the continuously cycling disk.

Alternately, instead of utilizing the power regulator noted above, a manual power regulator may be utilized, a separate one for each electrical motor — such as therefore a plurality of variable resistors as a switch mechanism for each of the plurality of racing electrical motors, whereby the total speed and time of activation is manually controlled; this becomes a significant part of a manually-controlled game where too-great a speed will cause a particular one of the racing surries to topple-over if there is a curve in the track being negotiated at that moment, thus a matter of judgment and skill being introduced into such manually-controlled game, which never-the-less still uses the animated-legs horse and sulky as another feature of the present invention. Vehicular-track interlocking structure anchors the vehicles.

The invention may be better understood by making reference to the following drawings.

THE FIGURES

FIG. 1 is a diagrammatic and front perspective view of a preferred combination of a plurality of racing horses and sulkies, in in-part view, with partial cut-away of the casing of the power regulator, and with alternate manually-controlled switches.

FIG. 2 illustrates again diagrammatically, a view as taken along lines 2—2 of the power regulator of FIG. 1, in partial cross-section of various of the elements, and side view of others.

FIG. 3 illustrate diagrammatically, a view taken along lines 3—3 of FIG. 2, also in cross-section of some elements and front view of others, in particular illustration of the rotating disk and the mechanical series of contact strips thereof.

Figure 4:
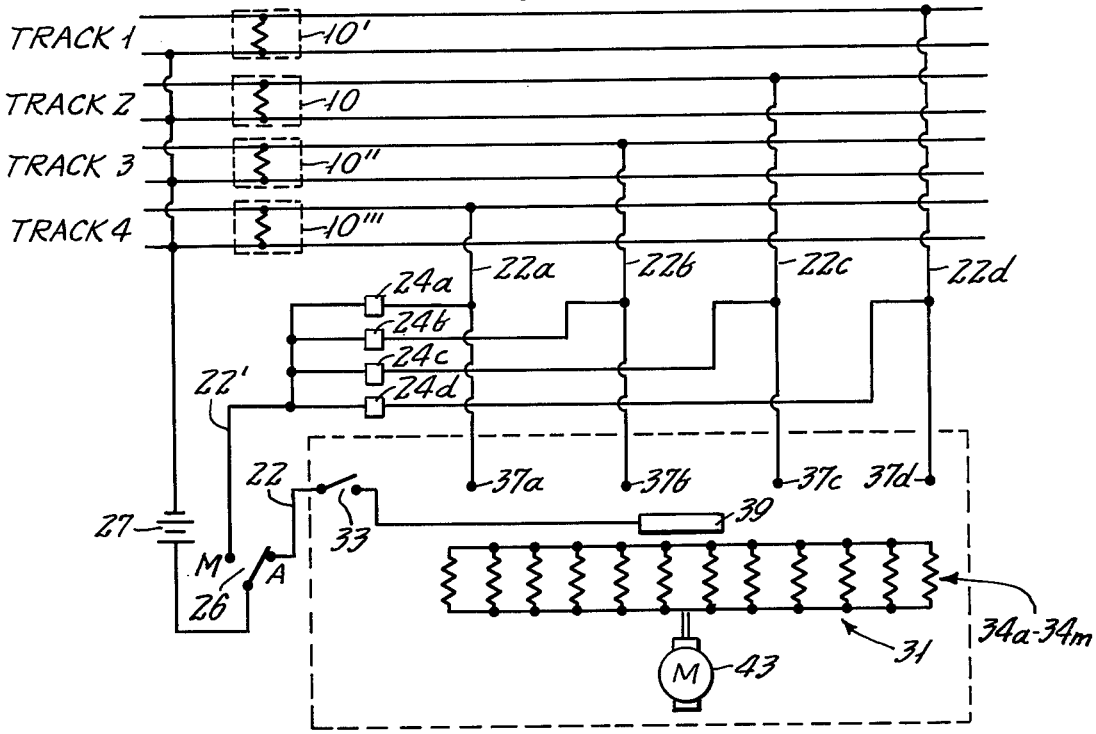

FIG. 4 graphically and diagrammatically illustrates the typical circuitry of the embodiment of FIG. 1.

Figure 5:
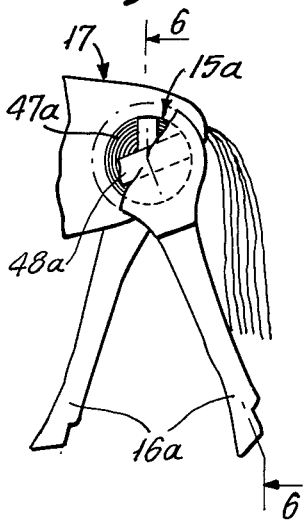

FIG. 5 illustrates in in-part and partial cut-away view, the structural arrengement of a suspended pivoted pair of legs with regard to the electromagnetic motor.

Figure 6:
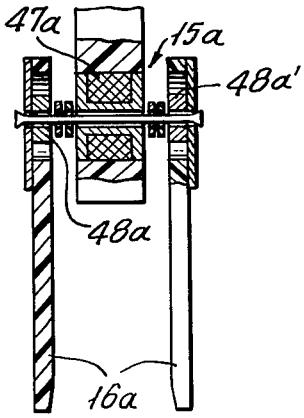

FIG. 6 illustrates a view taken along lines 6—6 of the FIG. 5 view, in-part cross-section and in-part side view thereof, for the suspended pair of animated legs.

Figure 7:
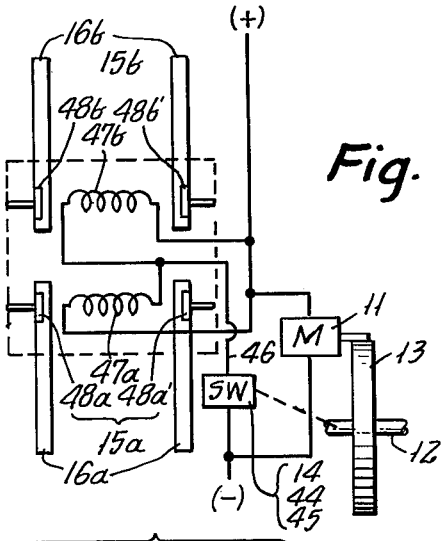

FIG. 7 illustrates graphically and diagrammatically the typical circuitry of the electromagnetic motors in parallel electrically, as a part of the electrical commutator cicuitry mounted on the shaft (axle) of the wheel illustrated, in an in-part view of the shaft and surry thereof.

Figure 8:
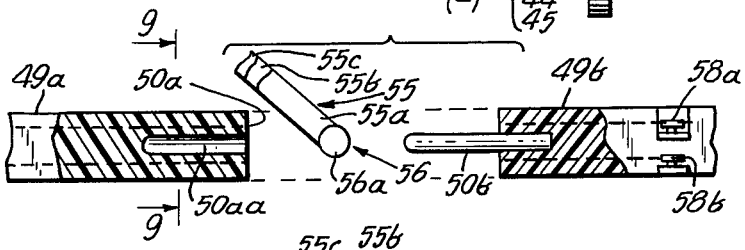
Figure 9:
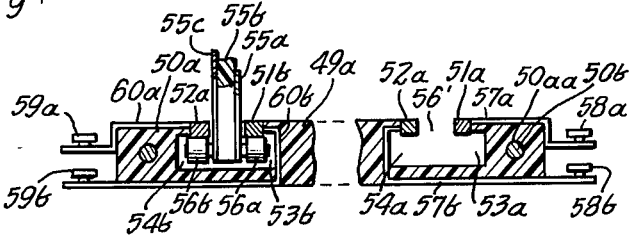

FIGS. 8 through 10 illustrate an alternate and preferred track mechanism for the above-illustrated invention.

FIG. 8 illustrates in side expanded view in partial cut-away, the preferred track and sulky-anchoring mechanism & track assemblying mechanism.

FIG. 9 illustrates a view as taken along line 9—9 of FIG. 8, in cross-section through the preferred track.

FIG. 10 illustrates typical appearance of a preferred sulky and current-providing tongue-anchoring mechanism & track.

DETAILED DESCRIPTION OF THE INVENTION

FIGS. 1 through 7 illustrate a common preferred embodiment, and accordingly various Figures may be referred to in following the description in detail below, without specific reference having to be made to particular Figures in each instance, and also accordingly like-elements of different Figures have common identifying indicia. FIGS. 8–10 are to a preferred embodiment.

In FIG. 1, there is illustrated the best view of all parts of the preferred combination as it would appear to the discerning eye, of course graphically and some-what diagrammatically illustrated. A motorized animated sulky and harnessed horse, cumulatively represented as 10, includes a motor unit 11 having an axle shaft 12 mounting fixedly a wheel 13 and also having a commutator disk 14 mounted thereon providing power to electromagnetic motors **15*a* and 15*b* (FIGS. 5 through 7) of respective pairs 16*a* and 16*b* of pivotedly-suspended legs of the harnessed horse body 17 with symbolic driver-structure 18. The forward guide 18 and rearward guide structures 19 ride along the track grooves and rails, to guide the sulky and horse. The rearward guide structures 19 may be of conventionally known types and structures and mechanism of operation, or may be of an improved design, and serve(s) to complete electrical circuit for direct current flow from the power rail and return to the grounded return-current rail, respectively, of various parallel tracks 20 and individual rails thereof. The ground lead 21 derives from all return-current rails (typically four, being here illustrated as evidenced by four input rail leads 22*a*, 22*b*, 22*c*, and 22*d*). In electrical series between the power lead 22 and the respective power leads 22*a*, 22*b*, 22*c*, and 22*d*, is the power regulator 23, and between the power lead 22' and the respective power leads 22*a*, 22*b*, 22*c*, and 22*d*, are the manual actuatable regulator switches 24*a*, 24*b*, 24*c*, and 24*d*,** each being a rheostat switch ranging typically from substantially no resistance when the trigger thereof is fully pulled, to maximum-off position resistance when the trigger (spring-biased) is not pulled.

Between power lead 25 and power leads 22 and 22', is the selector switch 26 for selecting either alternately of the leads 22 and 22', for automatic power feed versus manual power feed to the several racing electric motors.

Power source 27 is a source of direct electric current. The motor of the power regulator 23 may be either a direct current motor or an AC motor, as might be desired, and lead 28 and plug 29 typically receives power from a receptacle 30, the motor serving to very slowly rotate the disk 31, the motor being typically represented as motor 43.

Between the lead 22 and in-electrical-series lead 32 is an off-on switch 33 for making and breaking circuit to the energizing power for the respective ones of the racing electrical motors.

Indirectly, the lead 32 furnishes electrical power to the various contact strips 34 arranged in mechanical series along a face of the disk 31. The various contact strips are electrically conductive, and are intermittently contacted from time to time as the disk 31 rotates, by take-off slide-contacts 36a, 36c, etc., of respective terminals 37a, 37b, 37c, etc., from which leads 22a, 22b, 22c, and 22d respectively extend in series electrical circuits thereof. In electrical series with respective contact plates are electrical resistors 38a through 38m; typically the resistors differ from one-another in electrical resistance, and typically — as shown, the contact strips differ from one-another in length of the respective contact strip 34a through 34m. All of the above-noted resistors are in electrical series with the conductor ring 39 which receives power through brush 40 to which lead 32 is connected, which conductor ring 39 is mounted around rotary shaft member 41 fixedly mounted rotatably on and with shaft 42 driven by the electric motor 43.

The electrical commutator illustrated in FIG. 1 may be of any conventional type or design, and is typically illustrated as the commutator disk 14, having a contact element 44 receiving electrical direct current power by a conventional mechanism such as by a conductor ring and brush receiving power from a lead in parallel with the motor 11. A brush, or the like, intermittently — as the commutator disk 14 cyclically revolves with the axle shaft 12 — the contact element 44 makes closed-circuit contact with the brush 45 thereby providing current flow through lead 46 to respective electromagnetic motors 15a, and 15b, inclusive of coils and the metallic-like material mounted on the set of paired legs and moved responsive to induction upon activation of the respective coils. Each electromagnetic motor includes a coil such as coils 47a and 47b, and at leat one leg-mounted responsive material such as bar magnets 48a, 48a', 48b, and 48b'.

While only one entire horse and sulky combination 10 is illustrated in FIG. 1, in in-part view there is illustrated another one 10', and in FIG. 4, in phantom, there is shown typical aligned starting positions for four horse and sulky combinations 10, 10', 10'', and 10'''.

FIGS. 8 through 10 illustrate an alternate common embodiment of the invention, identical to prior embodiments except to the extent otherwise set forth. Accordingly, a track 49 is a set of two or more track pieces 49a and 49b, for example, preferably fitted together by male-female mating mechanism as female portion 50a having female receptacle 50aa, and male element 50b. Typically the anchoring mechanism of current-transmitting tongue 55 permits the placing of the tongue-mounted anchoring wheels (rollers) 56 within groove-passage space 56' having over-hang wing spaces 53a, 53b, 54a, 54b, for example in which the individual anchoring wheels 56a and 56b are illustrated as anchored for the wing spaces 53b and 54b, being placed in the wing spaces before the track is pushed-together to assemble by the male element 50b being pressed into the female receptacle 50aa. A part of the overhang structure for the respective wing spaces includes the electric-current-transmitting rails 51a, and 52a, and 51b and 52b, for example, the respective anchoring wheels being biased upwardly against a bottom surface respectively each of the trails thereby establishing current-transmitting contact to, through, and by way of the respective anchoring wheels to the respective current-carrying elements of the particular tongue on which it is respectively mounted. The illustrated anchoring tongue 56 for example includes insulator strip 55b having mounted on opposite sides thereof the separated current-carrying strip elements 55a and 55c. The anchoring wheel 56a is rotatably mounted on the strip 55a, and the anchoring wheel 56b is rotatably mounted on the strip 55b. Accordingly, electrical terminal 59a may be an input or output terminal for electricity transmitted through a lead strip 60a to rail 52b, from which electricity is transferred between rail 52 and anchoring wheel 56b and its current-carrying strip 55c, for example. In like manner electrical conductance is present between electrical terminal 59b, lead strip 60b, rail 51b, anchoring wheel 56a, and strip element 55b. Circuitry of the various motors is operatively attached to the respective strip elements 55a and 55c.

As may be observed in FIG. 10, axle-shaft 66 of wheel 65 forms a pivot point between opposite ends 56 and 61 of a unitary member, the horse and motor units thereof as member 67 being mounted on the end 61 of the unitary member and accordingly the weight of the member 67 causing the end/current-transmitting tongue 55 to be biased upwardly whereby the anchoring wheels 56 are continually biased upwardly against the under-face surface of the rails 52 (52a and 51a, & 52b and 51b, for example). Also, as seen in each of FIGS. 8 and 10, the fore-to-aft width of the current-transmitting tongue 55 is sufficiently great, and the space between opposing spaced-apart edges of of rails 51b and 52b, and of 51a and 52b, for example, is sufficiently small in dimensions, as to bring-about a close-fit with the side-faces of the current-transmitting tongue such that freedom-of-play to and fro is significantly restricted to prevent the entire sulky and associated structure from twisting or turning to any deliterious extent such as wobbling or becoming jammed, or such as might cause the anchoring wheels 56 from losing good and effective electrical current-transmitting contact with the rails 52.

It is within the scope of the present invention to make such variations and modifications and substitution of equivalents as would be apparent to a person of ordinary skill.

I claim:

1. A switch selecting device comprising in combination: a plurality of electrical motors each having a separate input electrical lead and a separate output electrical from those of others of the plurality, at least one of the input leads and the output leads respectively being connected in electrical parallel, and the other of the input leads and output leads respectively being connected to separate one of a plurality of circuit making and breaking contacts; cyclic switch means for being connected in electrical circuit with said plurality of contacts each for making and breaking circuit for respective leads connected thereto, the cyclic switch means being further for providing a plurality of alternate power circuits intermittently and consecutively contactable of each of the circuit making and breaking contacts in repeating cycles and including a drive means for effecting cycling of the cyclic switch means, the drive means including drive switch means for starting and stopping the drive means, each of the plurality of alternate power circuits having power regulator means for determining and controlling total electrical energy passing therethrough per cycle of the cyclic switch means, the power regulator means being different for at least one of the alternate power circuits relative to the power regulator of others of the alternate power circuits; and a power source connected to provide closed-circuit direct current power in circuit to the alternate power circuits and the respective one of the plurality of electrical motors whenever respective ones of the alternate power circuits are in closed-circuit contact with at least one of said plurality of contacts; and activation switch means mounted in series within circuitry of the closed-circuit direct current power, for opening and closing intermittently circuit of the power source, whereby when the drive switch means is in a starting position such that the cyclic switch means is running and cycling continuously, closing circuit to the activation switch means results in different ones of the plurality of electrical motors receiving driving power in differing and unpredictable amounts within a predetermined time period of activation of the activation switch, and a plurality of second motor means, one matched with each electrical motor of the plurality of electrical motors, for becoming electrically activated each respectively intermittently, each second motor means comprising an electrical commutator in series electrically with an electromagnetic motor, the electrical commutator being mounted to be driven by a respective one of the plurality of electrical motors, and when driven by the electrical motor the electrical commutator repeatedly intermittently and alternately making and breaking-circuit to circuitry to the electromagnetic motor having its circuitry inclusive of a power source of electrical direct current.

2. A switch selecting device of claim 1, including a wheeled vehicle matched with each electrical motor of the plurality of electrical motors, each wheeled vehicle mounting one of the plurality of electrical motors and the electrical motor thereof driving the wheeled vehicle by driving a wheel thereof by way of a driving shaft of the electrical motor, and said electrical commutator being mounted as a part of and function of said driving shaft.

3. A switch selecting device of claim 2, including a symbolic horse structure with two pairs of legs, each pair separately pivotably suspended from the other pair, at least one of the pairs being inclusive of a material movably-responsive to an induced magnetic field and mounted in association with the electromagnetic motor as a part thereof, the electro-magnetic motor including an induction coil as a part of its circuitry, induceable of magentic induction sufficient to move said one pair when circuitry of the electromagnetic motor is electrically energized, such that intermittent energization thereof results in to and fro swinging movement of the pair of legs responsive to a function of the electrical commutator as the driving shaft is driven.

4. A switch selecting device of claim 1, including a symbolic horse structure with two pairs of legs, at least one of the pairs being separately and pivotably suspended for to and fro movement thereof partially responsive to gravity-pull and including a material movably-responsive to electrically-induced magnetic induction by said electro-magnetic motor's coils sufficiently to move the one pair when circuitry of the electromagnetic motor is electrically energized by the electrical commutator.

5. A switch selecting device of claim 4, including two of said electromagnetic motors in electrical parallel, each thereof having one of the pairs and the material associated operatively therewith for thereby imparting movement to both pairs when the circuitries thereof are electrically energized by the electrical commutator.

6. A switch selecting device of claim 5, in which circuitry of the respective two electromagnetic motors is arranged such that the pairs are movable in opposite directions to one-another when the electrical commutator energize the two electromagnetic motors.

7. A switch selecting device of claim 1, in which said power regulator means includes in electrical parallel arrangement, a plurality of movable electrical contact strips of diverse and different lengths commonly driven by said drive means such that motors energized in series therewith are run for intermittently varying periods of time proportional to respective lengths.

8. A switch selecting device of claim 7, in which said power regulator means further includes in electrical parallel arrangement, a plurality of electrical resistors of diverse and different resistances such that motors energized in series therewith are run at different speeds of revolutions per minute.

9. A switch selecting device of claim 1, in which said power regulator means further includes in electrical parallel arrangement, a plurality of electrical resistors of diverse and different resistances such that motors energized in series therewith are run at different speeds of revolutions per minute.

10. A switch selecting device of claim 1, including alternate-manual switch means for being selectively alternatively placed in circuit in place of said cyclic switch means and for thereupon being connected in electrical circuit with said plurality of contacts each for making and breaking circuit for respective leads connected thereto.

* * * * *